US010062342B2

(12) United States Patent
Pei et al.

(10) Patent No.: US 10,062,342 B2
(45) Date of Patent: Aug. 28, 2018

(54) LIQUID CRYSTAL DISPLAY (LCD) Q-PANEL, LCD PANEL AND LCD APPARATUS

(71) Applicant: BEIJING BOE OPTOELECTRONICS TECHNOLOGY CO., LTD., Beijing (CN)

(72) Inventors: Xiaoguang Pei, Beijing (CN); Haisheng Zhao, Beijing (CN); Haitao Ma, Beijing (CN); Yu Cao, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 753 days.

(21) Appl. No.: 13/948,481

(22) Filed: Jul. 23, 2013

(65) Prior Publication Data

US 2014/0055331 A1 Feb. 27, 2014

(30) Foreign Application Priority Data

Aug. 22, 2012 (CN) ..... 2012 1 0301460

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01)

(58) Field of Classification Search
None
See application file for complete search history.

(56) References Cited

U.S. PATENT DOCUMENTS 3,602,849 A * 8/1971 Geffe ..... H03H 11/42 330/302
4,322,691 A * 3/1982 Malchow ..... H03F 3/343 330/288

(Continued)

FOREIGN PATENT DOCUMENTS

CN 101290405 A 10/2008
CN 101424816 A 5/2009

(Continued)

OTHER PUBLICATIONS

Chinese Rejection Decision dated Jul. 3, 2014; Appln. No. 201210301460.9.

(Continued)

*Primary Examiner* — Nicholas Lee
(74) *Attorney, Agent, or Firm* — Ladas & Parry LLP

(57) ABSTRACT

Embodiments of the present invention provide a LCD Q-Panel, a LCD panel and a LCD apparatus, for solving the technical problem that there is a large loss of a signal over the resistance of the signal transmission line when the signal is loaded into a general signal connection port of the LCD Q-Panel in the prior art. The LCD Q-Panel provided in embodiments of the present invention comprises: a general signal connection port, at least one LCD panel comprising a signal connection point, and at least one voltage follower; the signal input from the general signal connection port is transmitted via the at least one voltage follower to the signal connection point connected to an output terminal of the at least one voltage follower and the LCD panel comprising the signal connection point.

14 Claims, 3 Drawing Sheets

(56) References Cited

U.S. PATENT DOCUMENTS

| | | | | |
|---|---|---|---|---|
| 5,148,118 | A * | 9/1992 | Dobkin | H03F 3/50 330/252 |
| 2002/0030656 | A1* | 3/2002 | Goto | G02F 1/133617 345/89 |
| 2005/0253777 | A1* | 11/2005 | Zehner | G06F 3/1446 345/1.3 |
| 2007/0046599 | A1 | 3/2007 | Kim et al. | |
| 2009/0243962 | A1* | 10/2009 | Hioki | G06F 3/1431 345/1.3 |
| 2012/0182169 | A1* | 7/2012 | Zhang | G01R 13/0272 341/155 |

FOREIGN PATENT DOCUMENTS

| | | | |
|---|---|---|---|
| CN | 102270415 | A | 12/2011 |
| JP | 09-146500 | A | 6/1997 |

OTHER PUBLICATIONS

First Chinese Office Action dated Oct. 10, 2013; Appln. No. 201210301460.9.

* cited by examiner

LIQUID CRYSTAL DISPLAY (LCD) Q-PANEL, LCD PANEL AND LCD APPARATUS

TECHNICAL FIELD

The present invention relates to a technical field of Thin Film Transistor Liquid Crystal Display (TFT-LCD), in particular, to a LCD Q-Panel, LCD panel and LCD apparatus.

BACKGROUND

At present, in the process for manufacturing a TFT-LCD, a glass substrate includes a plurality of LCD Q-Panels, wherein each Q-Panel comprises a plurality of LCD panels and has one or two sets of general signal connection port(s). The lengths of signal transmission lines between each LCD panel and the general signal connection port are different since the distances therebetween are different. During an actual manufacturing, all the signal transmission lines are made very thin to improve the utilization of the glass substrate; and since the Q-Panel is relatively large, the signal transmission lines between the LCD panel which is far away from the general signal connection port among the Q-Panel and the general signal connection port are relatively longer, and thus the resistances of these signal transmission lines are larger. When the same signals are loaded onto the general signal connection port of the Q-Panel, the paths along which the loaded signals are transferred to the individual LCD panels are shown in FIG. 1. As the distance between the LCD panel 12 and the general signal connection port 11 varies from one to another, the resistance of the signal transmission line 13 therebetween varies. FIG. 2 shows a schematic diagram of an equivalent resistance thereof, wherein $R_1$ represents a resistance of the signal transmission line between the general signal connection port 11 and the LCD panel $V_1$, $R_2$ represents a resistance of that between the LCD panel $V_1$ and the LCD panel $V_2$, $R_3$ represents a resistance of that between the LCD panel $V_2$ and the LCD panel $V_3$, . . . $R_n$ represents a resistance of that between the LCD panel $V_{n-1}$ and the LCD panel $V_n$, and so on.

In test, a testing signal is loaded into the general signal connection port of the Q-Panel, the resistance of the signal transmission line between the LCD panel and the general signal connection port gradually increases as the distance therebetween increases, and thus the voltage drop caused by the resistance increases continuously. Therefore, the farther the LCD panel is from the general signal connection port, the less the strength of the testing signal received by the LCD panel is, and thus the less the luminance of the LCD panel after being lighted up is, and in a certain situation, it can not even be lighted up, which affects the test seriously.

In summary, the resistance of the signal transmission line and the voltage drop caused by the resistance are relatively large when the length of the signal transmission line is long since the Q-Panel is large and the signal transmission line is thin, and thus it causes a large attenuation of the signal over the resistance of the signal transmission line when the signal is loaded into the general signal connection port.

SUMMARY

The embodiments of the present invention provide a LCD Q-Panel, a LCD panel and a LCD apparatus, for solving the technical problem that the signals are greatly attenuated over the resistances of the signal transmission lines when the signals are loaded into the general signal connection port of the LCD Q-Panel.

In view of the above problem, the LCD Q-Panel provided in the embodiments of the present invention comprises:

a general signal connection port, at least one LCD panel comprising a signal connection point, and at least one voltage follower; the signals input from the general signal connection port are transmitted via the at least one voltage follower to the signal connection point connected to an output terminal of the at least one voltage follower and the LCD panel comprising the signal connection point.

The embodiments of the present invention also provide a LCD panel which is obtained from the LCD Q-Panel provided in the embodiments of the present invention.

The embodiments of the present invention further provide a LCD apparatus comprising the LCD panel obtained from the LCD Q-Panel provided in the embodiments of the present invention.

The embodiments of the present invention can achieve at least the beneficial effects as follows:

In the LCD Q-Panel, the LCD panel and the LCD apparatus provided in the embodiments of the present invention, the LCD panel, in the LCD Q-Panel, being connected to the output terminal of the voltage follower receives the signal input from the general signal connection port via the voltage follower, wherein the signal is transferred via the voltage follower connected between the general signal connection port and the signal connection point of the LCD panel rather than over the signal transmission line directly, and since the voltage follower has a feature of a very high input impedance and a very low output impedance, the signal is almost fully transmitted to the voltage follower according to the voltage-dividing principle of a series circuit; in other words, the resistance of the signal transmission line between the general signal connection port and the signal connection point of the LCD panel has almost no influence on the signal transmitted over the signal transmission line segment, and thus the loss of the signal, input from the general signal connection port over the resistance of the signal transmission line, can be reduced.

DETAILED DESCRIPTION OF THE PREFERRED EMBODIMENTS

The embodiments of the present invention provide a LCD Q-Panel, LCD panel and LCD apparatus. In the LCD Q-Panel, a LCD panel connected to an output terminal of a voltage follower receives signals input from the general signal connection port via the voltage follower. Since the signals are transferred from the voltage follower connected between the general signal connection port and a signal connection point of the LCD panel rather than from the signal transmission lines directly, there is almost no loss, caused by the resistances of the signal transmission lines between the general signal connection port and a signal connection point of the LCD panel, in the signals transferred over the signal transmission lines, thus reducing the loss of the signals input from the general signal connection port over the resistances of the signal transmission lines.

The implementations of the LCD Q-Panel and LCD apparatus provided in the embodiments of the present invention are described in detail with reference to the accompanying drawings hereinafter.

The LCD Q-Panel provided in the embodiments of the present invention includes a general signal connection port, at least one LCD panel comprising a signal connection point, and at least one voltage follower; the signals input from the general signal connection port are transmitted to the signal connection point being connected to an output terminal of the at least one voltage follower and the LCD panel comprising the signal connection point via the voltage follower.

The above voltage follower can be located between any two adjacent LCD panels, with an input terminal of the voltage follower connected to the signal connection point of the LCD panel which is closer to the general signal connection port among the two adjacent LCD panels, and with an output terminal of the voltage follower connected to the signal connection point of the other LCD panel.

Figure 1:
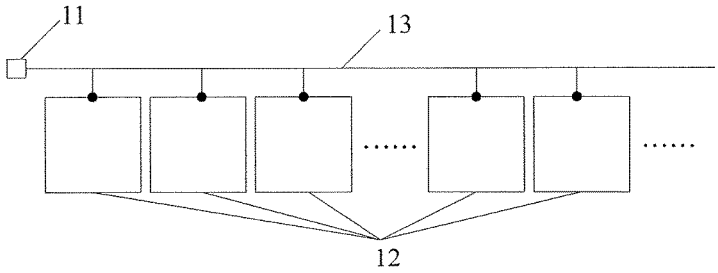
FIG. 1 is a schematic diagram showing paths for transferring the signals in the LCD Q-Panel in the prior art.
Figure 2:
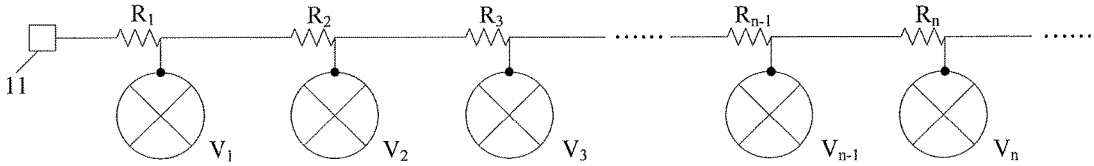
FIG. 2 is a schematic diagram showing equivalent resistances over the signal transmission lines in the LCD Q-Panel in the prior art.
Figure 3:
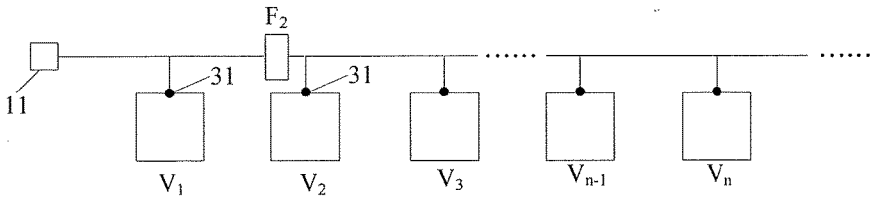
FIG. 3 is a schematic diagram showing a structure of a first LCD Q-Panel provided in an embodiment of the present invention.

For example, as shown in FIG. 3, the LCD Q-Panel includes a voltage follower, wherein a voltage follower $F_2$ is located between a LCD panel $V_1$ and a LCD panel $V_2$, an input terminal of the voltage follower $F_2$ is connected to a signal connection point 31 of the LCD panel $V_1$, and an output terminal of the voltage follower $F_2$ is connected to a signal connection point 31 of the LCD panel $V_2$.

Figure 4:
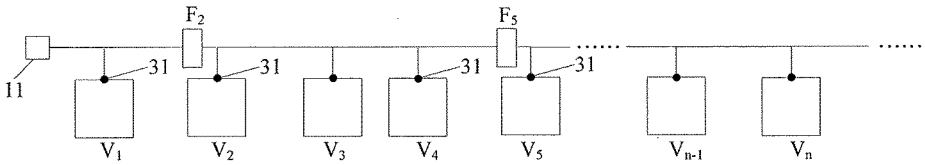
FIG. 4 is a schematic diagram showing a structure of a second LCD Q-Panel provided in an embodiment of the present invention.

Preferably, the LCD Q-Panel may further include a plurality of voltage followers, and there is a voltage follower located between any several adjacent LCD panels. For instance, as shown in FIG. 4, there is a voltage follower located among every three adjacent LCD panels in the LCD Q-Panel, wherein the voltage follower $F_2$ is located between the LCD panel $V_1$ and the LCD panel $V_2$, and the voltage follower $F_2$ is connected in the same manner as that shown in FIG. 3; the voltage follower $F_5$ is located between the LCD $V_4$ and the LCD $V_5$, with an input terminal of the voltage follower $F_5$ connected to the signal connection point 31 of the LCD panel $V_4$, and with an output terminal thereof connected to the signal connection point 31 of the LCD panel $V_5$, and so on. Thus, the attenuation of the signals, input from the general signal connection port 11 over the signal transmission lines between the general signal connection port 11 and the individual LCD panels, can be further reduced.

Figure 5:
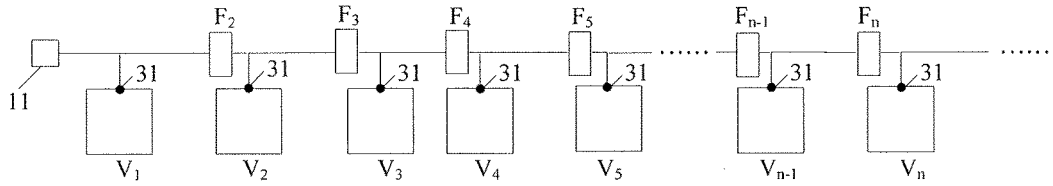
FIG. 5 is a schematic diagram showing a structure of a third LCD Q-Panel provided in an embodiment of the present invention.

Preferably, in the LCD Q-Panel provided in the embodiments of the present invention, there is a voltage follower located between every two adjacent LCD panels. As shown in FIG. 5, wherein the voltage follower $F_2$ is located between a LCD panel $V_1$ and a LCD panel $V_2$, and the voltage follower $F_2$ is connected in the same manner as that shown in FIG. 3; a voltage follower $F_3$ is located between the LCD panel $V_2$ and a LCD panel $V_3$, with an input terminal of the voltage follower $F_3$ connected to the signal connection point 31 of the LCD panel $V_2$, and with an output terminal thereof connected to the signal connection point 31 of the LCD panel $V_3$; a voltage follower $F_4$ is located between the LCD panel $V_3$ and a LCD panel $V_4$, with an input terminal of the voltage follower $F_4$ connected to a signal connection point 31 of the LCD panel $V_3$, and with an output terminal thereof connected to a signal connection point 31 of the LCD panel $V_4$; a voltage follower $F_5$ is located between the LCD panel $V_4$ and a LCD panel $V_5$, the voltage follower $F_5$ is connected in the same manner as that shown in FIG. 4; a voltage follower $F_{n-1}$ is located between a LCD panel $V_{n-2}$ (not shown in FIG. 5) and a LCD panel $V_{n-1}$, with an input terminal of the voltage follower $F_{n-1}$ connected to a signal connection point 31 of the LCD panel $V_{n-2}$, and with an output terminal thereof connected to a signal connection point 31 of the LCD panel $V_{n-1}$; a voltage follower $F_n$ is located between the LCD panel $V_{n-1}$ and a LCD panel $V_n$, with an input terminal of the voltage follower $F_n$ connected to a signal connection point 31 of the LCD panel $V_{n-1}$, and with an output terminal thereof connected to a signal connection point 31 of the LCD panel $V_n$, and so on. Thereby, the resistance of the signal transmission line between the signal connection points of every two adjacent LCD panels has almost no influence on the signals transferred over this signal transmission line segment, and thus the signals transmitted from the general signal connection port 11 to the individual LCD panels are almost not attenuated.

Figure 6:
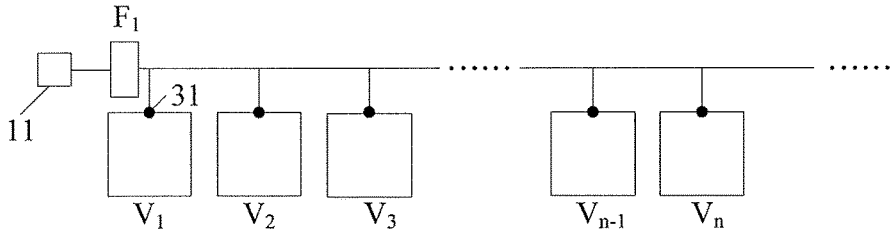
FIG. 6 is a schematic diagram showing a structure of a fourth LCD Q-Panel provided in an embodiment of the present invention.

In addition, the voltage follower $F_1$ included in the LCD Q-Panel provided in the embodiments of the present invention can also be located between the LCD panel $V_1$ closest to the general signal connection port 11 and the general signal connection port 11. As shown in FIG. 6, an input terminal of the voltage follower $F_1$ is connected to the general signal connection port 11, and an output terminal thereof is connected to a signal connection point 31 of the LCD panel $V_1$. Thereby, the attenuation of the signals loaded by the general signal connection port 11 over the resistances of the signal transmission lines between the general signal connection port 11 and the LCD panel $V_1$, can be reduced since the input impedance of the voltage follower is very high and the output impedance thereof is very low.

Preferably, a distance between the voltage follower and the LCD panel connected to the output terminal of the voltage follower does not exceed a preset distance. The shorter the distance between the voltage follower and the LCD panel connected to the output terminal of the voltage follower is, the less the attenuation of the signal transmitted to the LCD panel connected to the output terminal of the voltage follower which can be guaranteed by the voltage follower is. In an actual application, the preset distance may be 1 mm in general, but it is not limited to this.

Figure 7:
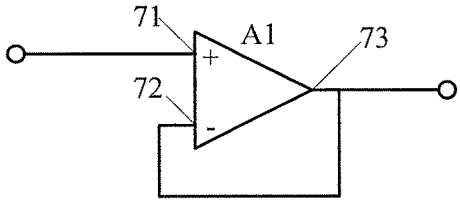
FIG. 7 is a schematic diagram showing a structure of a voltage follower provided in an embodiment of the present invention.

As shown in FIG. 7, particularly, the above voltage follower includes an operational amplifier A1, wherein a positive input 71 of the operational amplifier A1 serves as the input terminal of the voltage follower, and a negative input 72 of the operational amplifier A1 is connected to the output 73 of the operational amplifier A1 via a wire and serves as the output terminal of the voltage follower.

Figure 8:
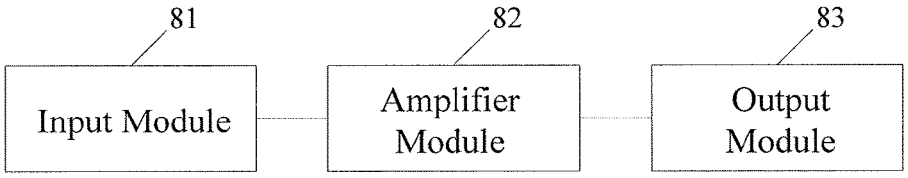
FIG. 8 is a schematic diagram showing a structure of an operational amplifier provided in an embodiment of the present invention.

As shown in FIG. 8, particularly, the operational amplifier includes an input module 81, an amplifier module 82 and an output module 83, wherein the input module 81 receives an input signal and suppresses the common mode interference in the input signal, the amplifier module 82 amplifies the input signal received by the input module 81, and the output module 83 outputs the input signal amplified from the amplifier module 82.

Figure 9:
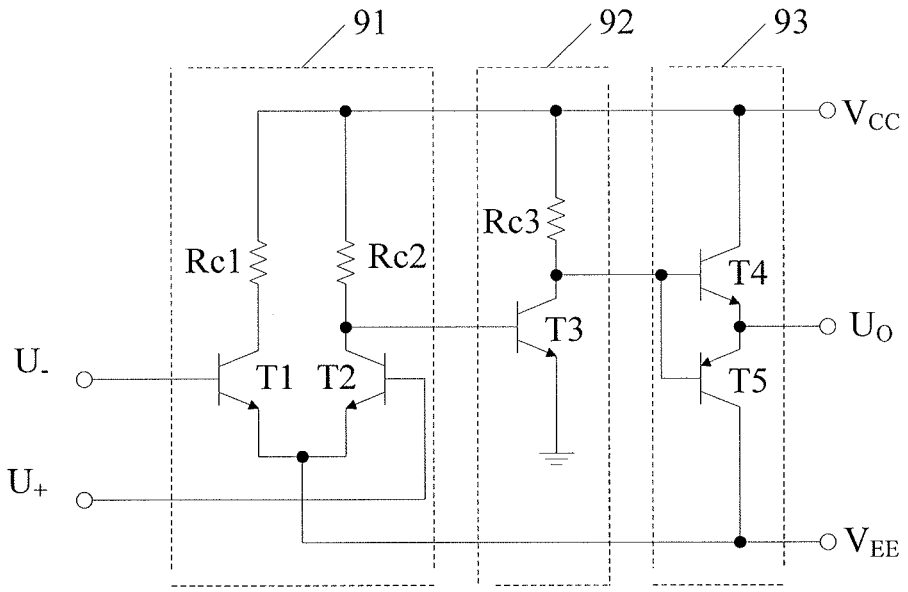
FIG. 9 is a schematic diagram showing a circuit structure of a simple operational amplifier provided in an embodiment of the present invention.

The operational amplifier A1 can employ a circuit structure of a simple operational amplifier shown in FIG. 9, wherein the input module 81 adopts the circuit structure of the input stage 91 of the simple operational amplifier, the amplifier module 82 adopts the circuit structure of the intermediate stage 92 of the simple operational amplifier, and the output module 83 adopts the circuit structure of the output stage 93 of the simple operational amplifier.

The circuit of the input stage 91 of the simple operational amplifier includes a resistor Rc1, a resistor Rc2, a triode T1 and a triode T2, wherein the base of the triode T1 servers as the negative input $U_-$ of the simple operational amplifier, the collector of the triode T1 is connected to one terminal of the resistor Rc1, and the other terminal of the resistor Rc1 is connected to a positive power supply Vcc, and the emitter of the triode T1 is connected to a negative power supply $V_{EE}$; the base of the triode T2 serves as the positive input $U_+$ of the simple operational amplifier, and the collector of the triode T2 is connected to one terminal of the resistor Rc2, and the other terminal of the resistor Rc2 is connected to the positive power supply Vcc, and the emitter of the triode T2 is connected to the negative power supply $V_{EE}$.

The circuit of the intermediate stage 92 of the simple operational amplifier includes a resistor Rc3 and a triode T3, wherein the base of the triode T3 is connected to the node where the resistor Rc2 in the input stage 91 and the collector of the triode T2 are connected, the collector of the triode T3 is connected to one terminal of the resistor Rc3, the other terminal of the resistor Rc3 is connected to the positive power supply Vcc, and the emitter of the triode T3 is grounded.

The circuit of the output stage 93 of the simple operational amplifier includes a triode T4 and a triode T5, wherein the base of the triode T4 is connected to the base of the triode T5 and connected to the node where the resistor Rc3 in the intermediate stage 92 and the collector of the triode T3 are connected, the collector of the triode T4 is connected to the positive power supply Vcc, the emitter of the triode T4 is connected to the emitter of the triode T5 and serves as the output $U_o$ of the simple operational amplifier, and the collector of the triode T5 is connected to the negative power supply $V_{EE}$.

In an actual application, all of the resistors Rc1, Rc2, and Rc3, and the triodes T1, T2, T3, T4 and T5 can be implemented by use of the existing array technical process during the process for manufacturing the TFT-LCD without adding any extra technical processes.

Further, the voltage follower included in the LCD Q-Panel provided in the embodiments of the present invention is constructed in Thin Film Transistors and Thin Film Resistors.

The circuit of the voltage follower and the circuit of the operational amplifier in the embodiments are only for illustration, and those skilled in the art can also employ other voltage followers and operational amplifiers. For example, the circuit can be constructed by using the transistors such as CMOS (Complementary Metal Oxide Semiconductor) Transistors instead of triodes. In an actual application, preferably, the above transistors are manufactured as Thin Film Transistors (TFTs) smaller than a pixel in size and the above resistor are manufactured as Thin Film Resistors so as to decrease the area of the glass substrate occupied. In an actual application, the TFTs in the operational amplifier can employ the same type of TFTs as those in the pixel circuit of the LCD panel, and can also employ different type of TFTs from those in the pixel circuit of the LCD panel.

Further, the voltage follower and the LCD panel do not overlap each other on the LCD Q-Panel so that the part comprising the voltage follower can be cut out when the Q-Panel is divided into a single display panel, thus further improving the utilization of the area of the display panel.

Further, the embodiments of the present invention provide a LCD panel which is obtained from the LCD Q-Panel provided in the embodiments of the present invention.

Further, the embodiments of the present invention provide a LCD apparatus including the LCD panel which is obtained from the LCD Q-Panel provided in the embodiments of the present invention.

Obviously, those skilled in the art can make modifications and variations to the present invention without departing from the spirits and scopes of the present invention. Thus, provided that these modifications and variations belong to the scopes claimed by the attached claims and the equivalences thereof, it is intended to cover such modifications and variations in the present invention.

What is claimed is:

1. A Liquid Crystal Display (LCD) Q-Panel, comprising a general signal connection port and at least one LCD panel comprising a signal connection point, wherein the LCD Q-Panel includes at least one voltage follower;

a signal input from the general signal connection port is transmitted via the at least one voltage follower to the signal connection point connected to an output terminal of the at least one voltage follower and the LCD panel comprising the signal connection point, the at least one voltage follower has a feature of a high input impedance and a low output impedance;

wherein an input terminal of the voltage follower is connected to the signal connection point of the LCD panel which is closer to the general signal connection port among two adjacent LCD panels, and an output terminal of the voltage follower is connected to the signal connection point of the other LCD panel; or wherein an input terminal of the voltage follower is connected to the general signal connection port, and an output terminal of the voltage follower is connected to the signal connection point of the LCD panel closest to the general signal connection port;

wherein the voltage follower comprises an operational amplifier including a first transistor, a second transistor, a third transistor, a fourth transistor, a fifth transistor, a first resistor, a second resistor, and a third resistor, wherein bases of the first and second transistors are a negative input and a positive input of the operational amplifier, respectively, collectors of the first, second, and third transistors are connected with a positive power supply via the first, second, and third resistors, respectively, emitters of the first and second transistors are connected with a negative power supply, a base of the third transistor is connected directly with the collector of the second transistor, and an emitter of the third transistor is grounded directly, and wherein bases of the fourth and fifth transistors are both connected directly with the collector of the third transistor, collectors of the fourth and fifth transistors are connected directly with the positive power supply and the negative power supply, respectively, and emitters of the fourth and fifth transistors are connected directly with each other and serve as an output of the operational amplifier, the fourth and fifth transistors being of different channel types.

2. The LCD Q-Panel according to claim 1, wherein, the positive input of the operational amplifier serves as the input terminal of the voltage follower, and the output of the operational amplifier is connected to the negative input of the operational amplifier via a wire and serves as the output terminal of the voltage follower.

3. The LCD Q-Panel according to claim 2, wherein the operational amplifier further includes an input module, an amplifier module and an output module;

the input module is configured to receive an input signal and suppress common mode interference in the input signal;

the amplifier module is configured to amplify the input signal received by the input module; and the output module is configured to output the input signal amplified from the amplifier module.

4. The LCD Q-Panel according to claim 1, wherein the voltage follower is constructed in Thin Film Transistors and Thin Film Resistors.

5. The LCD Q-Panel according to claim 1, wherein positions of the voltage follower and the LCD panel do not overlap on the LCD Q-Panel.

6. A Liquid Crystal Display (LCD) panel, wherein the LCD panel is obtained from the LCD Q-Panel according to claim 1.

7. The LCD Panel according to claim 6, wherein, the positive input of the operational amplifier serves as the input terminal of the voltage follower, and an output of the operational amplifier is connected to the negative input of the operational amplifier via a wire and serves as the output terminal of the voltage follower.

8. The LCD Panel according to claim 7, wherein the operational amplifier further includes an input module, an amplifier module and an output module;

the input module is configured to receive an input signal and suppress common mode interference in the input signal;

the amplifier module is configured to amplify the input signal received by the input module; and the output module is configure to output the input signal amplified from the amplifier module.

9. The LCD Panel according to claim 6, wherein the voltage follower is constructed in Thin Film Transistors and Thin Film Resistors.

10. The LCD Panel according to claim 6, wherein positions of the voltage follower and the LCD panel do not overlap on the LCD Q-Panel.

11. A Liquid Crystal Display (LCD) apparatus, wherein it comprises the LCD panel obtained from the LCD Q-Panel according to claim 1.

12. The LCD Panel apparatus according to claim 11, wherein, the positive input of the operational amplifier serves as the input terminal of the voltage follower, and an output of the operational amplifier is connected to the negative input of the operational amplifier via a wire and serves as the output terminal of the voltage follower.

13. The LCD Panel apparatus according to claim 12, wherein the operational amplifier further includes an input module, an amplifier module and an output module;

the input module is configured to receive an input signal and suppress common mode interference in the input signal;

the amplifier module is configured to amplify the input signal received by the input module; and the output module is configured to output the input signal amplified from the amplifier module.

14. The LCD Panel apparatus according to claim 11, wherein the voltage follower is constructed in Thin Film Transistors and Thin Film Resistors.

* * * * *